US005079132A

United States Patent [19]

Mitsui et al.

[11] Patent Number: 5,079,132

[45] Date of Patent: * Jan. 7, 1992

[54] METHOD FOR FORMING A COLOR POSITIVE HAVING IMPROVED COLOR REPRODUCTION

[75] Inventors: Akio Mitsui; Nobuyuki Kimura; Junichi Tamano; Mitsugi Kawakami, all of Kanagawa, Japan

[73] Assignee: Fuji Photo Film Co., Ltd., Kanagawa, Japan

[ * ] Notice: The portion of the term of this patent subsequent to Nov. 14, 2006 has been disclaimed.

[21] Appl. No.: 245,192

[22] Filed: Sep. 16, 1988

[30] Foreign Application Priority Data

Sep. 16, 1987 [JP] Japan ..... 62-229856

[51] Int. Cl.[5] ..... G03C 7/18

[52] U.S. Cl. ..... 430/359; 430/357; 430/378; 430/379; 430/383; 430/396; 430/507

[58] Field of Search ..... 430/378, 379, 383, 357, 430/359, 396, 507

[56] References Cited

U.S. PATENT DOCUMENTS

| | | | |
|---|---|---|---|
| 1,860,218 | 5/1932 | Baker | 430/396 |
| 2,265,547 | 12/1941 | Schneider | 95/2 |
| 2,997,389 | 8/1961 | Boon . | |
| 3,085,468 | 4/1963 | Hehn | 88/24 |
| 3,672,898 | 6/1972 | Schwan et al. | 96/74 |
| 4,050,807 | 9/1977 | Barbieri | 355/32 |
| 4,801,520 | 1/1989 | Inoue et al. | 430/378 |
| 4,835,091 | 5/1989 | Inoue et al. | 430/378 |
| 4,880,726 | 11/1989 | Shiba et al. | 430/376 |

FOREIGN PATENT DOCUMENTS

| | | |
|---|---|---|
| 027764 | 8/1988 | European Pat. Off. . |
| 53-64037 | 6/1978 | Japan . |

*Primary Examiner*—Charles L. Bowers, Jr.
*Assistant Examiner*—Janis L. Dote
*Attorney, Agent, or Firm*—Sughrue, Mion, Zinn, Macpeak & Seas

[57] ABSTRACT

A method for forming a color positive image which comprises steps of:

(a) exposing a color positive type silver halide material including a support having thereon at least two silver halide emulsion layers which have different spectral sensitivity distribution from each other, to light passed through a filter having at least one absorption band where light is absorbed in a sharp width; at least one absorption peak thereof being in a wavelength of from 480 to 520 nm or from 580 to 620 nm, the optical density of the absorption peak being at least 0.8; the $\frac{3}{4}$ value width of the absorption peak, designated as W $\frac{3}{4}$, being at least 5 nm and the $\frac{3}{4}$ value width of the absorption peak and the $\frac{1}{4}$ value width of the absorption peak, designated as W $\frac{1}{4}$, satisfying the following relation:

$$W\tfrac{3}{4} = W\tfrac{1}{4} \leqq 30 \text{ nm.}$$

and (b) developing the exposed material. The method according to the present invention provides a color positive image faithful in color reproduction to various color originals, containing various colors provided by different color materials.

15 Claims, 1 Drawing Sheet

METHOD FOR FORMING A COLOR POSITIVE HAVING IMPROVED COLOR REPRODUCTION

FIELD OF THE INVENTION

This invention relates to a method of obtaining a color positive directly from a color original, and more specifically, to a method for reproducing the chroma and hue of colors more faithfully to the original.

BACKGROUND OF THE INVENTION

A number of methods have been used to obtain a color positive directly on a photosensitive material from a color original. Typically, light from a halogen lamp or the like is cast on a color original, and the reflected light or transmitted light is focused with a lens or the like onto the surface of a photosensitive material for exposure. Then, development is performed to obtain a positive. The color original includes, for example, a transmission type, such as a color slide or a motion picture positive film, and a reflection type, such as a color print, color-printed matter, an illustration and a painting. The photosensitive material is one used in a process for obtaining a positive directly, including a reversal material, such as color reversal film, color duplicating film or color reversal paper; an autopositive material, such as autopositive color film or autopositive color paper; and a diffusion transfer material, such as instant film or diffusion transfer type dry color paper. For these types of materials, the following two processes have been mainly used to adjust the color balance of the resulting positive image. The first is the additive color process, in which light is divided into the three primary colors, blue, green and red, and exposure is performed three times. Because of the necessity for three separate exposures, this process is complicated and poor in productivity; however, it provides a positive satisfactory in color separation and color reproduction. The other process is the subtractive color process, in which cut-filters for yellow, magenta and cyan are inserted somewhere in the optical system, and the color balance is adjusted by adjusting the amount of exposure. With this process, exposure is performed once, the instruments and procedure are simple, and the printing time is short. Despite these advantages, it involves the disadvantages that color separation and color reproduction are poor.

With the subtractive exposure process, therefore, a method of forming a color image with good color separation and good color reproduction is desired. To attain this purpose, it has been suggested to sharpen the spectral sensitivity distribution of the photosensitive material to blue, green and red colors, thereby raising the accuracy of color separation with which to duplicate color density from the original.

There have been attempts to sharpen the spectral sensitivity distribution of a photosensitive material by incorporating a suitable light-absorbing dye therein [JP-B-51-1419 (corresponding to U.S. Pat. No. 3,746,539), JP-A-52-20830 or JP-A-57-112750 (The term "JP-A" as used herein refers to a "published, unexamined Japanese patent application", and the term "JP-B" as used herein refers to an "examined Japanese patent publication")]. In a negative printing process, there have also been attempts to sharpen spectral sensitivity with the use of an external filter (JP-A-53-64037, JP-A-51-113627).

The incorporation of a light-absorbing dye in a photosensitive material, however, has the disadvantage that the absorption spectrum of the dye is too broad, and the dye absorbs light in the region that should be transmitted, thereby lowering the spectral sensitivity of the photosensitive material. The method involving the use of an external filter relates to a negative printing process rather than a positive-positive printing process in which a color positive is obtained directly from a color original. Color reproduction in a positive-positive printing process is difficult compared with a negative-positive process. With a negative-positive process, materials for use in printing are all negative films, and images are composed mostly of azomethine dyes (coupling products of couplers with developing agents). The range of tolerance for the spectral sensitivity of the photosensitive material to be printed on, therefore, is relatively broad. In the case of a positive-positive process, by contrast, the original is a transparency positive, a coupler-in-developer type color slide film or a coupler-in-emulsion type color slide film, all widely different in dyes to be developed. Reflection-type positive originals include a wide variety of materials, such as color picture prints, printed matter, paintings, illustrations, and real objects. The coloring materials making up the image are widely varied, including azomethine dyes, azo dyes, organic pigments and inorganic pigments. The absorption spectrum for each of them cannot be restricted to yellow, magenta or cyan with a virtually single spectrum as in the case of a negative film. The faithful reproduction of the original that uses these various coloring materials is a very difficult task with a photosensitive material for obtaining a direct color positive.

SUMMARY OF THE INVENTION

A first object of this invention is to provide a method for forming a positive-positive color photographic image with good color reproduction even when applied in a subtractive color process which is more efficient in printing work than the additive color process.

A second object of this invention is to provide a method of obtaining directly a color positive faithful in color reproduction from an original with various colors resulting from different color materials.

It has now been found that these and other objects of the present invention are attained by a method for forming a color positive image which comprises the steps of:

(a) exposing a color positive type silver halide material containing a support having thereon at least two silver halide emulsion layers which have different spectral sensitivity distribution from each other, to light passed through a filter having at least one absorption band where light is absorbed in a sharp width; at least one absorption peak thereof being in a wavelength of from 480 to 520 nm or from 580 to 620 nm; the optical density of the absorption peak being at least 0.8; the $\frac{3}{4}$ value width of the absorption peak (the width of the absorption band corresponding to $\frac{3}{4}$ of the absorption peak intensity; designated as $W\frac{3}{4}$) being at least 5 nm and the $\frac{3}{4}$ value width of the absorption peak and the $\frac{1}{4}$ value width of the absorption peak (the width of the absorption band corresponding to $\frac{1}{4}$ of the absorption peak intensity; designated as $W\frac{1}{4}$) satisfying the following relation:

$$W\tfrac{3}{4} - W\tfrac{1}{4} \leqq 30 \text{ nm.}$$

and (b) developing the exposed material.

Further, it has now been found that these and other objects of the present invention are attained by a method for forming a color positive image which comprises the steps of:

(a) exposing a color positive, type silver halide material containing a support having thereon a blue-sensitive layer, a green-sensitive layer and a red-sensitive layer to light passed through a filter whose absorption peak wavelength is longer than the longest wavelength of spectral sensitivity distribution of the blue-sensitive layer and is shorter than an absorption peak wavelength (which means a maximum sensitivity wavelength, but which means a maximum sensitivity wavelength in the shorter wavelength side when there are two or more maximum sensitivities) of spectral sensitivity distribution of the green-sensitive layer, or whose absorption peak wavelength is longer than the longest wavelength of spectral sensitivity distribution of the green-sensitive layer and is shorter than an absorption peak wavelength (which means a maximum sensitivity wavelength, but which means a maximum sensitivity wavelength in the shorter wavelength side when there are two or more maximum sensitivities) of spectral sensitivity distribution of the red-sensitive layer and (b) developing the exposed material.

The term "the longest wavelength of spectral sensitivity distribution of the blue-sensitive layer or the green-sensitive layer" means the wavelength at which the sensitivity is lower than the maximum sensitivity of the blue-sensitive layer or the green-sensitive layer by 2 as a log E value (E represents an exposure amount), respectively.

DETAILED DESCRIPTION OF THE INVENTION

Figure 1:
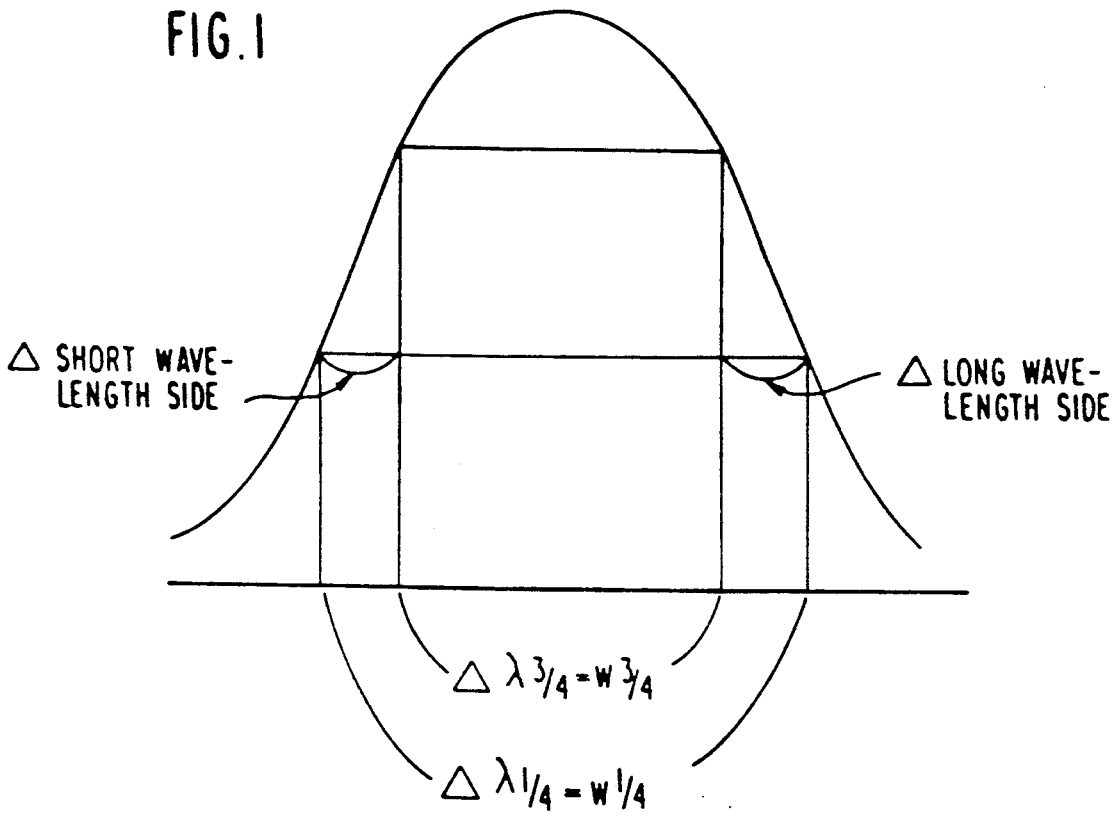
FIG. 1 shows the absorption peak wavelength of an optical filter in accordance with this invention.

The optical filter that can be used in this invention may have any construction provided that it satisfies the relationships required by this invention. For instance, it includes a transparent support (e.g., glass, or transparent plastic) having a highly dielectric multi-layer deposited film thereon. A preferred filter is obtained by depositing an organic dielectric, an inorganic oxide, a metal or its compound, or the like in many layers on a filter substrate (transparent support). For example, it can be prepared similarly to the multi-layer film interference filter described in JP-A-57-190908, or the multi-layer film optical filter using titanium oxide and magnesium fluoride described in JP-A-54-53548. This way, a filter suitable for use in this invention can be produced.

The optical filter of this invention has at least one absorption peak wavelength within the region of from 480 to 520 nm, preferably from 490 to 510 nm, or within the region of from 580 to 620 nm, preferably from 590 to 610 nm. The preferred absorption peak wavelength falls within the range of from 580 to 620 nm. More preferably, the optical filter has an absorption peak wavelength in each of the lower and higher wavelength regions.

Although an absorption wavelength region of the optical filter as described in U.S. Pat. No. 4,050,807 is present in the overlapped region of spectral sensitivity, an absorption wavelength region of the optical filter of this invention may not be present in the overlapped region of spectral sensitivity, but is preferably present in the longer wavelength side than that of the overlapped region, by which preferred effects can be obtained. That is, the decline in sensitivity due to the optical filter is minimal and the effects of improving color purity can be obtained.

The $\frac{3}{4}$ value width of the absorption peak of the filter ($W\frac{3}{4}$) is preferably at least 5 nm and at most 35 nm, and more preferably it is at least 10 nm and at most 25 nm. The relationship ($W\frac{1}{4}-W\frac{3}{4}$) required by this invention is at most 30 nm and at least 0 nm; however, is preferably at most 20 mn and more preferably at most 10 mn. The peak value of the absorption intensity produces sufficient effects if the optical density is at least 0.8, preferably at least 1.0, more preferably at least 1.5. A lower value of baseline absorption of the filter is preferred, and a transmittance of at least 50% would be acceptable if the absorption by the support (gas, plastic or the like) is taken into account. Preferably, the transmittance is at least 80%. It is preferred that the filter has an anti-reflection coating. It is also preferred that the filter should have an ultraviolet absorption at a wavelength of at most 400 nm and/or an infrared absorption at a wavelength of at least 700 nm.

The method for preparing the optical filter for use in the present invention is described in Japanese Patent Application No. 148382/88 in detail.

The optical filter of the present invention may be provided anywhere between the light source and the photosensitive material, preferably between the light source and a reflecting original.

The color positive type silver halide material usable in this invention includes a coupler-in-developer type color reversal film; a coupler-in-emulsion type color reversal film; and a coupler-in-emulsion type color reversal paper that can provide a positive image by a color reversal process; Ciba Chrome (Ciba Co., Ltd.) capable of providing a positive image by the silver dye bleach process; an autopositive color film and an autopositive color paper capable of providing a direct positive image by the color negative process; an instant photography film capable of forming a positive image by the diffusion transfer process; and a dry color film or a dry color paper capable of forming a positive image by the heat developable diffusion transfer process. These photosensitive materials are described in Shinichi Kikuchi et al, *Kagaku Shashin Binran* (Vol. 1), published by Maruzen Publishing Co., Tokyo, Japan, (Jun. 15, 1960) pages 559–564 and 569; James, *The Theory of the Photographic Process*, (4th ed., 1977), pages 466 to 480.

Photosensitive materials and processing methods preferably used in this invention will be described in more detail below.

The preferred silver halide contained in the photographic emulsion layer of the color reversal paper for use in this invention is silver iodobromide containing about 10 to 0.5 mol %, preferably 10 to 2 mol %, of silver iodide, or silver chloroiodobromide containing about 50 mol % or less of silver chloride. The preferred silver halide in the direct positive emulsion for use in this invention is silver chlorobromide or silver bromide.

The silver halide grains in the photographic emulsion may have a regular crystal form, such as cubic, octahedral or tetradecahedral; an irregular crystal form, such as spherical or tabular; crystal defects such as a twinning plane; or combinations thereof.

The grains of the silver halide may be fine grains with sizes of about 0.2 micron or less, or large grains with a projected area diameter as large as about 10 microns. They may be polydisperse or monodisperse, but the use of a monodisperse emulsion with a coefficient of variation of 15% or less is preferred.

Silver halide photographic emulsions that can be used in this invention can be prepared by conventional methods described, in *Research Disclosure* (hereinafter "RD"), Vol. 176, No. 17643, (December 1978), PP. 22-23, I. Emulsion preparation and types; id. No. 18716, (November 1979), P. 648; P. Glafkide, *Chemie et Phisique Photographique,* (Paul Montel, 1967); G. F. Duffin, *Photographic Emulsion Chemistry,* (Focal Press, 1966); and V. L. Zelikman et al., *Making and Coating Photographic Emulsion,* (Focal Press, 1964).

The monodisperse emulsions disclosed in U.S. Pat. Nos. 3,574,628 and 3,655,394 and British Patent 1,413,748 are also prefered.

Tabular grains with an aspect ratio of about 5 or more can be used in this invention. Such tabular grains can be prepared easily by the methods described in Gutoff, *Photographic Science and Engineering,* Vol. 14, PP. 248-257, (1970); U.S. Pat. Nos. 4,434,226, 4,414,310, 4,433,048 and 4,439,520; and British Patent 2,112,157.

The crystal structure may be uniform, or different in halogen composition between the inside and the outside, or a layered form. The crystals may have a silver halide of a different composition joined thereto epitaxially, or they may have a compound other than silver halide, such as silver rhodanide or lead oxide, joined thereto.

A mixture of grains of various crystal forms may be used in this invention.

The silver halide emulsion used in this invention is typically subjected to physical ripening, chemical ripening and spectral sensitization. Additives used in these steps are disclosed in the previously cited *Research Disclosure,* Nos. 17643 and 18716, as summarized in the following table.

Known photographic additives usable in this invention are also disclosed in these publications, and the following table indicates the relevant portions.

| | Type of additive | RD 17643 | RD 18716 |
|---|---|---|---|
| 1. | Chemical sensitizer | Page 23 | Page 648, right colomn |
| 2. | Sensitivity improver | | Page 648, right colomn |
| 3. | Spectral sensitizer, supersensitizer | Pages 23-24 | Page 648, right column to page 649, right column |
| 4. | Whitener | Page 24 | |
| 5. | Antifoggant and stabilizer | Pages 24-25 | Page 649, right column et seq. |
| 6. | Light absorber, filter dye, UV absorber | Pages 25-26 | Page 649, right column to page 650, left column |
| 7. | Anti-stain agent | Page 25, right column | Page 650, left to right columns |
| 8. | Dye image stabilizer | Page 25 | |
| 9. | Hardener | Page 26 | Page 651, left column |
| 10. | Binder | Page 26 | Page 651, left column |
| 11. | Plasticizer, lubricant | Page 27 | Page 650, right column |
| 12. | Coating aid, surfactant | Pages 26-27 | Page 650, right column |

-continued

| | Type of additive | RD 17643 | RD 18716 |
|---|---|---|---|
| 13. | Antistatic agent | Page 27 | Page 650, right column |

Various couplers can be used in this invention. Specific examples are described in the patents described in *Research Disclosure,* No. 17643, VII-C through G.

Preferred yellow couplers are disclosed, e.g., in U.S. Pat. Nos. 3,933,501, 4,022,620, 4,326,024 and 4,401,752; JP-B-58-10739; and British Patents 1,425,020 and 1,476,760.

The preferred magenta couplers are 5-pyrazolones and pyrazoloazoles. Particularly preferred compounds are disclosed in U.S. Pat. Nos. 4,310,619 and 4,351,897; European Patent 73,636; U.S. Pat. Nos. 3,061,432 and 3,725,067; *Research Disclosure,* Vol. 242, No. 24220, (June 1984); JP-A-60-33552; *Research Disclosure,* Vol. 242, No. 24230, (June 1984); JP-A-60-43659; and U.S. Pat. Nos. 4,500,630, and 4,540,654.

Examples of cyan couplers are phenol and naphthol couplers, and preferred compounds are disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173; West German Patent Application (OLS) No. 3,329,729; European Patent 121,365A; U.S. Pat. Nos. 3,446,622, 4,333,999, 4,451,559, and 4,427,767; and European Patent 161,626A.

Colored couplers for correcting unwanted absorption by developed dyes are preferably those disclosed in *Research Disclosure,* Vol. 176, No. 17643, VII-G; U.S. Pat. No. 4,163,670; JP-B-57-39413; U.S. Pat. Nos. 4,004,929 and 4,138,258; and British Patent 1,146,368.

Couplers with developed dyes having moderate diffusibility are preferably those disclosed in U.S. Pat. No. 4,366,237, British Patent 2,125,570, European Patent 96,570 and West German Patent Application (OLS) No. 3,234,533.

Typical examples of polymerized dye-forming couplers are described in U.S. Pat. Nos. 3,451,820, 4,080,211 and 4,367,282, and British Patent 2,102,173.

Couplers which release photographically useful residues upon coupling are also usable preferably in this invention. Development inhibitor-releasing couplers (DIR couplers) are preferably those disclosed in the patents described in the above-cited *RD* 17643, VII-F, JP-A-57-151944, JP-A-57-154234, JP-A-60-184248, and U.S. Pat. No. 4,248,962.

Couplers that imagewise release nucleating agents or development accelerators during development are preferably those disclosed in British Patents 2,097,140 and 2,131,188, JP-A-59-157638 and JP-A-59-170840.

Other couplers that can be used in photosensitive materials of this invention include, for example, competing couplers as described in U.S. Pat. No. 4,130,427; multiequivalent copulers as described in U.S. Pat. Nos. 4,283,472, 4,338,393 and 4,310,618; DIR redox compound releasing couplers as described in JP-A-60-185950; and couplers that release dyes recolored upon elimination as described in European Patent 173,302A.

The couplers for use in this invention can be introduced into photosensitive materials by various known methods for dispersion.

Examples of high-boiling solvents for use in the oil-in-water dispersion technique are described in U.S. Pat. No. 2,322,027.

The procedure and effects of latex dispersion, and specific examples of latices for impregnation are described in U.S. Pat. No. 4,199,363, West German Patent Application (OLS) Nos. 2,541,274 and 2,541,230.

The coupler-in-developer type color reversal film involves the use of a coupler soluble in the developer, rather than a hydrophobic coupler, and the soluble coupler is added to the color developing solution, not to the photosensitive material, as described in Shinichi Kikuchi et al, *Kagaku shashin binran* (Vol. 1), published by Maruzen Publishing Co., Tokyo, Japan, (Jun. 15, 1960).

Details of internal latent image type emulsions and silver halide grains that can be used in the direct positive systems, such as autopositive color films and autopositive color papers, in accordance with this invention are given on pages 4 to 7 and in the Examples of the specification of JP-A-63-81337.

The internal latent image type emulsions may be conversion type emulsions or core-shell type emulsions, but core-shell type emulsions are preferred.

Details of the color couplers usable in the direct positive system are given on pages 4 to 7 and in the Examples of the specification of JP-A-63-81337, and various compounds that can be incorporated in the photosensitive material (e.g. color fog restrainers, antifading agents, dyes) are described on pages 28–30 of the same application.

Suitable supports usable in this invention are described, for example, on page 28 of the above-cited RD No. 17643 and page 647, right column to page 648, left column of above-cited RD, No. 18716.

The photosensitive material for color photography in accordance with this invention can be developed by the ordinary methods described on pages 28–29 of the previously cited *RD* No. 17643, or in the left to right column of page 651, id. No. 18716.

The exposure methods for used in the image forming method of this invention include a surface exposure system and a scanning exposure system. As the scanning exposure system, a point scanning system such as a line (slit) scanning and a laser exposure can be employed.

If a direct positive type color photosensitive material is used in this invention, it is preferred that a direct positive color image be formed in the following manner. After imagewise exposure, color development is performed with a surface developing solution, preferably with a pH of 12 or less, containing an aromatic primary amine color developing agent, after or during a fogging treatment with light or a nucleating agent. Then, bleaching and fixing are carried out to form a direct positive color image. The pH of the developing solution is more preferably in the range of from 11.0 to 10.0. (see pages 9 to 15 of the specification of JP-A-63-81337)

The fogging treatment usable in this invention includes "light fogging", i.e., a method for applying a second exposure to the entire surface of the photosensitive layer, and "chemical fogging", a method for development in the presence of a nucleating agent. Development may be performed in the presence of a nucleating agent and fogging light. Alternatively, the photosensitive material containing the nucleating agent may be subjected to exposure for fogging.

The light-fogging method is described on pages 9 to 15, of the specification of JP-A-63-81337. The nucleating agent usable in this invention is described on pages 50–53 of the same application, and particularly, the use of compounds of formulae [N-1] and [N-2] identified there is preferred.

Nucleation Promotors that can be used in this invention are described on pages 54–57 of the same specification. Specific preferred examples include compounds (A-1) through (A-13) disclosed on pages 55–57 of the same specification.

Photosensitive materials and color image formation by the diffusion transfer color process applicable to this invention include the following. Those which use dye developers are described, for example, in U.S. Pat. No. 3,415,644. Those using couplers which release diffusible dyes are described, for instance, in Chapter 12 of T. H. James, *The Theory of the Photographic Process,* (4th ed., 1977). Those that use redox compounds which release diffusible dyes are described, for example, in *Photographic Science and Engineering,* Vol. 20, No. 4, pages 155–164, (July/August, 1976).

Color photosensitive materials and color image formation for heat development which can be used in this invention are described, for example, in JP-A-58-58543. Direct positive color films and direct positive color papers which can be used in this invention are described, for example, in EP 0,249,239 A2. Dry color films and dry color papers which can be used in this invention are described, for example, in EP 076,492 A2.

This invention will be described in greater detail below with reference to specific Examples, but the present invention is not to be construed as being limited thereto.

EXAMPLE 1

Silicon oxide and aluminum oxide were alternately deposited onto a glass plate as a support to prepare deposition film interference filter Nos. 101 through 129.

TABLE 1

| Filter No. | | Absorption peak wavelength (nm) | Width in peak absorption band $W_{\frac{3}{4}}$ (nm) | Width in peak absorption band $W_{\frac{1}{4}}$ (nm) | $W_{\frac{3}{4}}$-$W_{\frac{1}{4}}$ short wavelength side (nm) | $W_{\frac{3}{4}}$-$W_{\frac{1}{4}}$ long wavelength side (nm) | Peak-density |
|---|---|---|---|---|---|---|---|
| 101 | Comp. Ex. | 460 | 450~470 | 420~500 | 30 | 30 | 1.0 |
| 102 | This invention | 480 | 470~490 | 440~520 | " | " | " |
| 103 | This invention | 500 | 490~510 | 460~540 | " | " | " |
| 104 | This invention | 520 | 510~530 | 480~560 | " | " | " |
| 105 | Comp. Ex. | 540 | 530~550 | 500~580 | " | " | " |
| 106 | " | 560 | 550~570 | 520~600 | " | " | " |
| 107 | This inven- | 580 | 570~590 | 540~620 | " | " | " |

TABLE 1-continued

| Filter No. | | Absorption peak wavelength (nm) | Width in peak absorption band $W_{\frac{3}{4}}$ (nm) | Width in peak absorption band $W_{\frac{1}{4}}$ (nm) | $W_{\frac{3}{4}}-W_{\frac{1}{4}}$ short wavelength side (nm) | $W_{\frac{3}{4}}-W_{\frac{1}{4}}$ long wavelength side (nm) | Peak-density |
|---|---|---|---|---|---|---|---|
| | tion | | | | | | |
| 108 | This invention | 600 | 590~610 | 560~640 | " | " | " |
| 109 | This invention | 620 | 610~630 | 580~660 | " | " | " |
| 110 | Comp. Ex. | 640 | 630~650 | 600~680 | " | " | " |
| 111 | " | 590 | 580~600 | 530~650 | 50 | 50 | " |
| 112 | " | " | " | 540~640 | 40 | 40 | " |
| 113 | This invention | " | " | 550~630 | 30 | 30 | " |
| 114 | This invention | " | " | 560~620 | 20 | 20 | " |
| 115 | This invention | " | 585~595 | 565~615 | 20 | 20 | " |
| 116 | This invention | " | 570~610 | 550~630 | 20 | 20 | " |
| 117 | Comp. Ex. | " | 580~600 | 560~620 | 20 | 20 | 0.5 |
| 118 | This invention | " | " | " | " | " | 0.8 |
| 119 | This invention | " | " | " | " | " | 1.5 |
| 120 | This invention | " | " | " | " | " | 2.0 |
| 121 | This invention | 500 | 490~510 | 470~530 | 20 | 20 | 1.0 |
| 122 | This invention | 500 | 490~510 | 480~520 | 10 | 10 | 1.8 |
| 123 | This invention | 510 | 500~520 | 490~525 | " | 5 | " |
| 124 | This invention | 580 | 570~590 | 560~600 | " | 10 | " |
| 125 | This invention | 600 | 590~610 | 580~620 | " | " | " |
| 126 | This invention | 620 | 610~630 | 590~640 | 20 | " | " |
| 127 | This invention | 590 | 585~595 | 575~605 | 10 | " | " |
| 128 | This invention | " | 585~595 | 580~600 | 5 | 5 | " |
| 129 | This invention | " | 580~600 | 575~605 | " | " | " |

In connection with Table 1, it is to be understood that $\Delta\lambda_{\frac{3}{4}}$ represents $W_{\frac{3}{4}}$ and $\Delta\lambda_{\frac{1}{4}}$ represents $W_{\frac{1}{4}}$ in the absorption peak wavelength of the filter shown in FIG. 1, and that $W_{\frac{3}{4}}-W_{\frac{1}{4}}=(\Delta\text{short-wave side}+\Delta\text{long-wave side})$ in Table 1.

A paper support laminated on both surfaces thereof with polyethylene was coated sequentially with the following first through twelfth layers to prepare color photographic photosensitive materials. The first layer-coated side of the polyethylene coating contained 4.5 g/m$^2$ of titanium white as a white pigment and 0.05 g/m$^2$ of ultramarine as a bluing agent.

Composition of the Photosensitive Layers

The following description shows the components of the photosensitive layers and the amounts coated expressed in g/m$^2$. The amount of a silver halide emulsion coated is expressed as the amount calculated as silver.

| | |
|---|---|
| First layer (gelatin layer) | 1.30 |
| Gelatin | 1.30 |
| Second layer (antihalation layer) | |
| Black colloidal silver | 0.10 |
| Gelatin | 0.70 |
| Third layer (low-speed red-sensitive layer) | |
| Silver idodobromide emulsion (silver iodide content 5.0 mol %, mean grain size 0.4 μm) spectrally sensitized with red-sensitizing dyes (*1 and *2) in amounts of $8 \times 10^{-2}$ mol % and $4 \times 10^{-3}$ mol %, based on an amount of silver halide, respectively | 0.15 |
| Gelatin | 1.00 |
| Cyan coupler (*3) | 0.14 |
| Cyan coupler (*4) | 0.07 |
| Antifading agents (*5, *6, and *7 mixed in equal amounts) | 0.10 |
| Solvents for coupler (*8 and *9 mixed in equal amounts) | 0.06 |

-continued

| | |
|---|---|
| Fourth layer (high-speed red-sensitive layer) | |
| Silver iodobromide emulsion (silver iodide content 6.0 mol %, mean grain size 0.7 μm) spectrally sensitized with red-sensitizing dyes (*1 and *2) in amounts of $6 \times 10^{-2}$ mol % and $3 \times 10^{-3}$ mol %, based on an amount of silver halide, respectively | 0.15 |
| Gelatin | 1.00 |
| Cyan coupler (*3) | 0.20 |
| Cyan coupler (*4) | 0.10 |
| Antifading agents (*5, *6 and *7 mixed in equal amounts) | 0.15 |
| Solvents for coupler (*8 and *9 mixed in equal amounts) | 0.10 |
| Fifth layer (intermediate layer) | |
| Black colloidal silver | 0.02 |
| Gelatin | 1.00 |
| Color mixing preventing agent (*10) | 0.08 |
| Solvents for color mixing preventing agent (*11 and *12 mixed in equal amounts) | 0.16 |
| Polymer latex (*13) | 0.10 |
| Sixth layer (low-speed green-sensitive layer) | |
| Silver iodobromide emulsion (silver iodide content 2.5 mol %, grain size 0.4 μm) spectrally sensitized with a green-sensitizing dye (*14) in an amount of $3 \times 10^{-2}$ mol % based on an amount of silver halide | 0.10 |
| Gelatin | 0.80 |
| Magenta coupler (*15) | 0.10 |
| Antifading agent (*16) | 0.10 |
| Antistain agent (*17) | 0.01 |
| Antistain agent (*18) | 0.001 |
| Solvents for coupler (*11 and *19 mixed in equal amounts) | 0.15 |
| Seventh layer (high-speed green-sensitive layer) | |
| Silver iodobromide emulsion (silver iodide content 3.5 mol %, grain size 0.9 μm) spectrally sensitized with a green-sensitizing dye (*14) in an amount of $2 \times 10^{-2}$ mol % based on an amount of silver halide | 0.10 |
| Gelatin | 0.80 |
| Magenta coupler (*15) | 0.10 |
| Antifading agent (*16) | 0.10 |
| Antistain agent (*17) | 0.01 |
| Antistain agent (*18) | 0.001 |
| Solvents for coupler (*11 and *19 mixed in equal amounts) | 0.15 |
| Eighth layer (yellow filter layer) | |
| Yellow colloidal silver | 0.20 |
| Gelatin | 1.00 |
| Color mixing preventing agent (*10) | 0.06 |
| Solvents for color mixing preventing agent (*11 and *12 mixed in equal amounts) | 0.15 |
| Polymer latex (*13) | 0.10 |
| Ninth layer (low-speed blue-sensitive layer) | |
| Silver iodobromide emulsion (silver iodide content 2.5 mol %, grain size 0.5 μm) spectrally sensitized with a blue-sensitizing dye (*20) in an amount of 2 mol % based on an amount of silver halide | 0.15 |
| Gelatin | 0.50 |
| Yellow coupler (*21) | 0.20 |
| Antistain agent (*18) | 0.001 |
| Solvent for coupler (*9) | 0.05 |
| Tenth layer (high-speed blue-sensitive layer) | |
| Silver iodobromide emulsion (silver iodide content 2.5 mol %, grain size 1.2 μm) spectrally sensitized with a blue-sensitizing dye (*20) in an amount of 1 mol % based on an amount of silver halide | 0.25 |
| Gelatin | 1.00 |
| Yellow coupler (*21) | 0.40 |
| Antistain agent (*18) | 0.002 |
| Solvent for coupler (*9) | 0.10 |
| Eleventh layer (ultraviolet absorbing layer) | |
| Gelatin | 1.50 |
| Ultraviolet absorbers (*22, *6 and *7; *22: *6: *7 = 2 mol: 1 mol: 1 mol) | 1.00 |
| Color mixing preventing agent (*23) | 0.06 |
| Solvent for color mixing preventing agent | 0.15 |

-continued

| | |
|---|---|
| (*9) | |
| Irradiation preventing dye (*24) | 0.02 |
| Irradiation preventing dye (*25) | 0.02 |
| Twelfth layer (protective layer) | |
| Fine-grain silver chlorobromide emulsion (silver chloride content 97 mol %, mean grain size 0.2 μm) | 0.07 |
| Gelatin | 0.50 |
| Gelatin-hardening agent (*26) | 0.17 |

*1: 5,5'-Dichloro-3,3'-di(3-sulfobutyl-9-ethylthiacarbocyanine sodium salt)
*2: Triethylammonium-3-[2-{2-[3-(3-sulfopropyl)napththo(1,2-d)thiazoline-2-indenemethyl]-1-butenyl}-3-naphtho(1,2-d)thiazolino]propanesulfonate
*3: 2-[α-(2,4-Di-t-amylphenoxy)hexaneamido]-4,6-dichloro-5-ethylphenol
*4: 2-[2-Chlorobenzoylamido]-4-chloro-5-[α-(2-chloro-4-t-amylphenoxy)octaneamido]-phenol
*5: 2-(2-Hydroxy-3-sec-5-t-butylphenyl)benzotriazole
*6: 2-(2-Hydroxy-5-t-butylphenyl)benzotriazole
*7: 2-(2-Hydroxy-3,5-di-t-butylphenyl)-6-chlorobenzotriazole
*8: Di(2-ethylhexyl)phthalate
*9: Trinonylphosphate
*10: 2,5-Di-t-octylhydroquinone
*11: Tricresyl phosphate
*12: Dibutyl phthalate
*13: Polyethyl acrylate (molecular weight: 6,000)
*14: 5,5'-Diphenyl-9-ethyl-3,3'-disulfopropyloxacarbocyanine sodium salt
*15: 7-Chloro-6-methyl-2-[1-{2-octyloxy-5-(2-octyloxy-5-t-octylbenzene-sulfonamido}-2-propyl]-1H-pyrazolo[1,5-b][1,2,4]triazole
*16: 3,3,3',3'-Tetramethyl-5,6,5',6'-tetrapropoxy-1,1'-bisspiroindane
*17: 3-(2-Ethylhexyloxycarbonyloxy)-1-(3-hexadecyloxyphenyl)-2-pyrazoline
*18: 2-Methyl-5-t-octylhydroquinone
*19: Trioctyl phosphate
*20: Triethylammonium-3-[2-(3-benzylrhodanin-5-ylidene)-3-benzoxazolinyl]propane sulfonate
*21: α-Pivaloyl-α-[(2,4-dioxo-1-benzyl-5-ethoxyhydantoin-3-yl)-2-chloro-5-(α-2,4-di-t-amylphenoxy)butaneamido]9 acetoanilide
*22: 5-Chloro-2-(2-hydroxy-3-t-butyl-5-t-octyl)phenylbenztriazole
*23: 2,5-Di-sec-octylhydroquinone
*24:

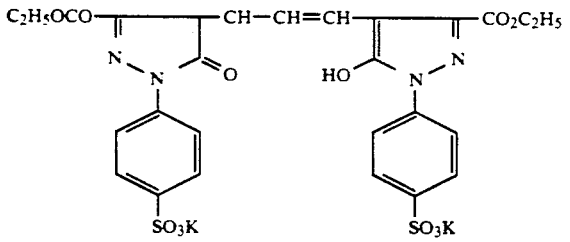

*25:

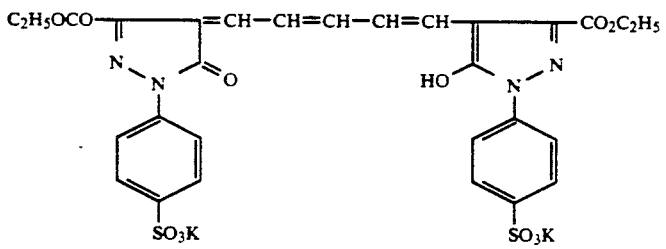

*26: 1,2-Bis(vinylsulfonylacetoamido)ethane

A Macbeth color checker was photographed with a coupler-in-emulsion type reversal film (RDP, a product of Fuji Photo Film Co., Ltd.), which was treated with CR-56P to make a positive film. The resulting positive film was printed onto the photosensitive material to obtain Sample No. 200. Dry light type ISO 100 was used as a light source. Prints obtained with the aforementioned Filter Nos. 101 to 129 interposed between the light source and the positive film during printing were designated Sample Nos. 201 to 229. Printing was performed with the gray as Neutral 5 of the Macbeth Color Checker being adjusted with YMC (Yellow, Magenta and Cyan) filters to provide a gray with a density of 1.0. The results are shown in Table 2. The development step was carried out in accordance with the process described below.

The processing was done in the following manner by means of an automatic processor (roller transfer type, CSR II R 3160, manufactured by Noritsu Kabushiki Kaisha) until the cumulative amount of the relenisher reached 3 times the capacity of the processing tank. Then, measurements were made.

| Processing step | Time (sec.) | Temp. (°C.) | Capacity of processing tank (liters) | Amount of replenisher (ml/m²) |
|---|---|---|---|---|
| First development | 75 | 38 | 8 | 330 |
| First washing (1) | 45 | 33 | 5 | — |
| First washing (2) | 45 | 33 | 5 | 5000 |
| Reversal exposure | 15 | 100 lux | | |
| Color development | 135 | 38 | 15 | 330 |
| Second washing | 45 | 33 | 5 | 1000 |
| Bleach-fix (1) | 60 | 38 | 7 | — |
| Bleach-fix (2) | 60 | 38 | 7 | 220 |
| Third washing (1) | 45 | 33 | 5 | — |
| Third washing (2) | 45 | 33 | 5 | — |
| Third washing (3) | 45 | 33 | 5 | 5000 |
| Drying | 45 | 75 | | |

The first washing steps were carried out by means of a two-tank countercurrent system, where a replenisher was supplied into the first washing tank (2), the solution overflown from the first washing tank (2) was introduced into the bottom of the first washing tank (1), and the solution overflown from the first washing tank (1) was drained out therefrom. The third washing steps were carried out by means of a three-tank countercurrent system, where a replenisher was supplied into the third washing tank (3) was introduced into the bottom of the third washing tank (2), the solution overflown from the third washing tank (2) was introduced into the bottom of the third washing tank (1), and the solution overflown from the third washing tank (1) was drained out therefrom.

Each of the processing solutions had the following composition:

| First Development | Solution | Replenisher |
|---|---|---|
| Nitrilo-N,N,N-trimethylene phosphonic acid pentasodium salt | 1.0 g | 1.0 g |
| Diethylenetriaminepentaacetic acid pentasodium salt | 3.0 g | 3.0 g |
| Potassium sulfite | 30.0 g | 30.0 g |
| Potassium thiocyanate | 1.2 g | 1.2 g |
| Potassium carbonate | 35.0 g | 35.0 g |
| Potassium hydroquinonemonosulfonate | 25.0 g | 25.0 g |
| 1-Phenyl-4-hydroxymethyl-4-methyl-3-pyrazolidone | 2.0 g | 2.0 g |
| Potassium bromide | 0.5 g | — |
| Potassium iodide | 5.0 mg | — |
| Water to make | 1000 ml | 1000 ml |
| pH | 9.60 | 9.70 |

The pH was adjusted with hydrochloric acid or potassium hydroxide.

| Color development | Solution | Replenisher |
|---|---|---|
| Benzyl alcohol | 15.0 ml | 18.0 ml |
| Diethylene glycol | 12.0 ml | 14.0 ml |
| 3,6-Dithia-1,8-octanediol | 0.20 g | 0.25 g |
| Nitrilo-N,N,N-trimethylene phosphonic acid pentasodium salt | 0.5 g | 0.5 g |

-continued

| Color development | Solution | Replenisher |
|---|---|---|
| Diethylenetriaminepentaacetic acid pentasodium salt | 2.0 g | 2.0 g |
| Sodium sulfite | 2.0 g | 2.5 g |
| Hydroxylamine sulfate | 3.0 g | 3.6 g |
| N-Ethyl-N-(β-methanesulfonamidoethyl)-3-methyl-aminoanilinesulfuric acid salt | 5.0 g | 8.0 g |
| Brightening agent (diaminostilbene-type) | 1.0 g | 1.2 g |
| Potassium bromide | 0.5 g | — |
| Potassium iodide | 1.0 mg | — |
| Water to make | 1000 ml | 1000 ml |
| pH | 0.25 | 10.40 |

The pH was adjusted with hydrochloric acid or potassium hydroxide.

| Bleach-fix bath | (Solution was same as replenisher) |
|---|---|
| Ethylenediaminetetraacetic acid disodium salt dihydrate | 5.0 g |
| Ammonium ethylenediaminetetraacetato ferrate (III) monohydrate | 80.0 g |
| Sodium sulfite | 15.0 g |
| Ammonium thiosulfate (700 g/l) | 160 ml |
| 2-Mercapto-1,3,4-triazole | 0.5 g |
| Water to make | 1000 ml |
| pH | 6.50 |

The pH was adjusted with acetic acid or aqueous ammonia.

TABLE 2

| Sample No. | Filter | | Sensitivity (relative sensitivity) B | G | R | Color reproduction (chroma) Red | Green | Blue |
|---|---|---|---|---|---|---|---|---|
| 200 | Crude glass | Comp. Ex. | 100 | 100 | 100 | 10.0 | 8.9 | 10.2 |
| 201 | 101 | Comp. Ex. | 10 | 98 | 98 | 10.0 | 8.7 | 9.5 |
| 202 | 102 | This invention | 65 | 87 | " | 10.0 | 9.0 | 11.5 |
| 203 | 103 | This invention | 86 | 79 | " | 10.0 | 9.3 | 12.5 |
| 204 | 104 | This invention | 94 | 62 | " | 10.0 | 9.0 | 11.6 |
| 205 | 105 | Comp. Ex. | 95 | 9 | " | 9.8 | 8.7 | 10.1 |
| 206 | 106 | Comp. Ex. | 96 | 9 | 97 | 19.8 | 8.3 | 10.2 |
| 207 | 107 | This invention | " | 59 | 92 | 10.6 | 9.3 | 10.2 |
| 208 | 108 | This invention | " | 92 | 81 | 11.7 | 9.5 | 10.2 |
| 209 | 109 | This invention | " | 96 | 56 | 10.9 | 9.3 | 10.1 |
| 210 | 110 | Comp. Ex. | " | " | 10 | 9.0 | 8.8 | 10.2 |
| 211 | 111 | Comp. Ex. | " | 34 | 42 | 8.9 | 8.6 | 10.1 |
| 212 | 112 | Comp. Ex. | " | 46 | 55 | 9.5 | 8.8 | 10.1 |
| 213 | 113 | This invention | " | 81 | 86 | 11.8 | 9.5 | 10.2 |
| 214 | 114 | This invention | " | 87 | 89 | 12.0 | 9.65 | 10.3 |
| 215 | 115 | This invention | " | 90 | 90 | 11.9 | 9.5 | 10.2 |
| 216 | 116 | This invention | " | 82 | 86 | 12.1 | 9.7 | 10.3 |
| 217 | 117 | Comp. Ex. | 97 | 91 | 92 | 10.5 | 9.2 | 10.1 |
| 218 | 118 | This in- | 97 | 89 | 90 | 11.0 | 9.3 | 10.1 |

TABLE 2-continued

| Sample No. | Filter | | Sensitivity (relative sensitivity) B | G | R | Color reproduction (chroma) Red | Green | Blue |
|---|---|---|---|---|---|---|---|---|
| | | vention | | | | | | |
| 219 | 119 | This invention | 95 | 85 | 87 | 12.8 | 9.8 | 11.2 |
| 220 | 120 | This invention | 94 | 83 | 85 | 13.1 | 9.8 | 11.3 |
| 221 | 121 | This invention | 82 | 45 | 54 | 11.7 | 9.3 | 12.3 |
| 222 | 122 | This invention | 96 | 85 | 98 | 11.8 | 9.8 | 12.6 |
| 223 | 123 | This invention | 96 | 82 | 98 | 11.8 | 9.9 | 12.8 |
| 224 | 124 | This invention | 97 | 91 | 90 | 12.6 | 9.7 | 10.5 |
| 225 | 125 | This invention | " | 96 | 85 | 12.7 | 9.8 | 10.4 |
| 226 | 126 | This invention | " | " | 72 | 13.1 | 9.7 | 10.4 |
| 227 | 127 | This invention | " | " | 88 | 13.0 | 9.8 | 10.5 |
| 228 | 128 | This invention | " | " | 90 | 13.1 | 9.9 | 10.4 |
| 229 | 129 | This invention | " | " | 88 | 13.1 | 9.9 | 10.4 |

The sensitivities in Table 2 represent the relative sensitivities of red-, green- and blue-sensitive layers when exposed with the use of Filter Nos. 101 through 129. The values of color reproduction represent the values of chromas of red, green and blue according to the Munsell color system, as described in Newhall, S. M. et al, J. Opt. Soc. Am., Vol. 33, pages 385 (1943).

When the spectral sensitivity distribution of the photosensitive materials obtained in Example 1 were measured, the longest wavelength of blue-sensitive layer or green-sensitive layer was 500 nm or 560 nm, respectively. Further, the peak wavelength of green-sensitive layer or red-sensitive layer was 548 nm or 650 nm, respectively.

Table 2 shows that the samples according to this invention provided improvements in the chromas of prints with minimal decline in the sensitivity.

Particularly, Table 2 shows that Sample Nos. 219, 220 and 222 to 229 provided remarkable effects of improving color reproduction with minimal decline in the sensitivity.

EXAMPLE 2

A paper support (thickness 100 microns) laminated on both sides thereof with polyethylene LAYER (each having 20 microns thick) was coated on one side with the first to fourteenth layers and coated on the back side with the fifteenth and sixteenth layers as described below to prepare color photographic photosensitive materials. The polyethylene coating on the first side contained 4.5 g/m$^2$ of titanium white as a white pigment and 0.02 g/m$^2$ of ultramarine as a bluing agent.

Composition of the Photosensitive Layers

The following description shows the components of the photosensitive layers and the amounts coated expressed in g/m$^2$. The amount of a silver halide emulsion coated is expressed as the amount calculated as silver. The emulsion used in each layer was prepared in accordance with the production method for the emulsion EMI described below, except that the emulsion of the fourteenth layer was a Lippmann emulsion that had not been subjected to surface chemical sensitization.

| | |
|---|---|
| First layer (antihalation layer) | |
| Black colloidal silver | 0.10 |
| Gelatin | 1.30 |
| Second layer (intermediate layer) | |
| Gelatin | 0.70 |
| Third layer (low-speed red-sensitive layer) | |
| Silver bromide emulsion (mean grain size 0.3 μm, grain size distribution [coefficient of variation] 8%, octahedral) spectrally sensitized with red-sensitizing dyes (ExS-1,2 and 3) in amounts of 7 × 10$^{-2}$ mol %, 4 × 10$^{-3}$ mol % and 1 × 10$^{-2}$ mol %, based on an amount of silver halide, respectively | 0.06 |
| Silver chlorobromide emulsion (silver chloride content 5 mol %, mean grain side 0.45 μm, grain size distribution 10%, octahedral) spectrally sensitized with red sensitizing dyes (ExS-1,2 and 3) in amounts of 6 × 10$^{-2}$ mol %, 4 × 10$^{-3}$ mol % and 1 × 10$^{-2}$ mol %, based on an amount of silver halide, respectively | 0.10 |
| Gelatin | 0.10 |
| Cyan coupler (ExC-1) | 0.11 |
| Cyan coupler (ExC-2) | 0.10 |
| Antifading agent (Cpd-2,3,4 and 13 mixed in equal amounts) | 0.12 |
| Dispersing medium for coupler (Cpd-5) | 0.03 |
| Solvent for coupler (Solv-7,2 and 3 mixed in equal amounts) | 0.06 |
| Fourth layer (high-speed red-sensitive layer) | |
| Silver bromide emulsion (mean grain size 0.60 μm, grain size distribution 15%, octahedral) spectrally sensitized with red-sensitizing dyes (ExS-1,2 and 3) in amounts of 5 × 10$^{-2}$ mol%, 3 × 10$^{-3}$ mol % and 5 × 10$^{-3}$ mol %, based on an amount of silver halide, respectively | 0.14 |
| Gelatin | 1.00 |
| Cyan coupler (ExC-1) | 0.15 |
| Cyan coupler (ExC-2) | 0.15 |
| Antifading agent (Cpd-2,3,4 and 13 mixed in equal amounts) | 0.15 |
| Dispersing medium for coupler (Cpd-5) | 0.03 |
| Solvent for coupler (Solv-7,2 and 3 mixed in equal amounts) | 0.10 |
| Fifth layer (intermediate layer) | |
| Gelatin | 1.00 |
| Antifading agent (Cpd 7) | 0.08 |
| Solvent for antifading agent (Solv-4 and 5 mixed in equal amounts | 0.16 |
| Polymer latex (Cpd-8) (particle size: 0.01 micron) | 0.10 |
| Sixth layer (low-speed green-sensitizing layer) | |
| Silver bromide emulsion (mean grain size 0.25 μm, grain size distribution 8%, octahedral) spectrally sensitized with a green-sensitizing dye (ExS-3) in an amount of 3 × 10$^{-2}$ mol % based on an amount of silver halide | 0.04 |
| Silver bromide emulsion (mean grain size 0.45 μm, grain size distribution 11%, octahedral) spectrally sensitized with green-sensitizing dyes (ExS-3 and 4) in amounts of 2 × 10$^{-2}$ mol % and 1 × 10$^{-2}$ mol %, based on an amount of silver halide, respectively | 0.06 |
| Gelatin | 0.80 |
| Magenta coupler (ExM-1 and 2 mixed in equal amounts) | 0.11 |
| Antifading agent (Cpd-9) | 0.10 |
| Antistain agent (Cpd-10 and 22 mixed in equal amounts) | 0.014 |
| Antistain agent (Cpd-23) | 0.001 |
| Antistain agent (Cpd-12) | 0.01 |
| Dispersing medium for coupler (Cpd-5) | 0.05 |
| Solvent for coupler (Solv-4 and 6 mixed in equal amounts) | 0.15 |
| Seventh layer (high-speed green-sensitive layer) | |
| Silver bromide emulsion (mean grain size 0.8 μm, grain size distribution 16%, octahedral) spectrally sensitized with green-sensitizing | 0.10 |

-continued

| | |
|---|---|
| dyes (ExS-3 and 4) in amounts of $1 \times 10^{-2}$ mol % and $5 \times 10^{-3}$ mol %, based on an amount of silver halide, respectively | |
| Gelatin | 0.80 |
| Magenta couplers (ExM-1 and 2 mixed in equal amounts) | 0.11 |
| Antifading agent (Cpd-9) | 0.10 |
| Antistain agent (Cpd-10 and 22 mixed in equal amounts) | 0.013 |
| Antistain agent (Cpd-23) | 0.001 |
| Antistain agent (Cpd-12) | 0.01 |
| Dispersing medium for coupler (Cpd-5) | 0.05 |
| Solvent for coupler (Solv-4 and 6 mixed in equal amounts) | 0.15 |
| Eighth layer (intermediate layer) | |
| Same as the fifth layer | |
| Ninth layer (yellow filter layer) | |
| Yellow colloidal silver | 0.20 |
| Gelatin | 1.00 |
| Color mixing preventing agent (Cpd-7) | 0.06 |
| Solvent for color mixing preventing agent (Solv-4 and 5 mixed in equal amounts) | 0.15 |
| Polymer latex (Cpd-8) (particle size: 0.01 micron) | 0.10 |
| Tenth layer (intermediate layer) | |
| Same as the fifth layer. | |
| Eleventh layer (low-speed blue-sensitive layer) | |
| Silver bromide emulsion (mean grain size 0.45 μm, grain size distribution 8%, octahedral) spectrally sensitized with blue-sensitizing dyes (ExS-5 and 6) in amounts of 1 mol % and 1 mol %, based on an amount of silver halide, respectively | 0.07 |
| Silver bromide emulsion (mean grain size 0.60 μm, grain size distribution 14%, octahedral) spectrally sensitized with blue-sensitizing dyes (ExS-5 and 6) in amounts of 1 mol % and 1 mol %, based on an amount of silver halide, respectively | 0.10 |
| Gelatin | 0.50 |
| Yellow coupler (ExY-1) | 0.22 |
| Antistation agent (Cpd-11) | 0.001 |
| Antifading agent (Cpd-6) | 0.10 |
| Dispersing medium for coupler (Cpd-5) | 0.05 |
| Solvent for coupler (Solv-2) | 0.05 |
| Twelfth layer (high-speed blue-sensitizing layer) | |
| Silver bromide emulsion (mean grain size 1.2 μm, grain size distribution 21%, octahedral) spectrally sensitized with blue-sensitizing dyes (ExS-5 and 6) in amounts of 0.7 mol % and 0.7 mol %, based on an amount of silver halide, respectively | 0.25 |
| Gelatin | 1.00 |
| Yellow coupler (ExY-1) | 0.41 |
| Antistain agent (Cpd-11) | 0.002 |
| Antifading agent (Cpd-6) | 0.10 |
| Dispersing medium for coupler (Cpd-5) | 0.05 |
| Solvent for coupler (Solv-2) | 0.10 |
| Thirteenth layer (ultraviolet-absorbing layer) | |
| Gelatin | 1.50 |
| Ultraviolet absorber (Cpd-1, 3 and 13 mixed in equal amounts) | 1.00 |
| Color mixing preventing agent (Cpd-6 and 14 mixed in equal amounts) | 0.06 |
| Dispersing medium (Cpd-5) | 0.05 |
| Solvent for ultraviolet absorber (Solv-1 and 2 mixed in equal amounts) | 0.15 |
| Irradiation preventing dye (Cpd-15 and 16 mixed in equal amounts) | 0.02 |
| Irradiation preventing dye (Cpd-17 and 18 mixed in equal amounts) | 0.02 |
| Fourteenth layer (protective layer) | |
| Fine-grain silver chlorobromide emulsion (silver chlorode content 97 mol %, mean grain size 0.2 μm) | 0.05 |
| Acrylate-modified copolymer of polyvinyl alcohol (degree of modification: 17%, molecular weight: about 10,000) | 0.02 |
| Mixture of polymethyl methacrylate particles (mean particle size 2.4 microns) and silicon oxide (mean particle size 5 microns) in equal amounts | 0.05 |
| Gelatin | 1.50 |
| Gelatin hardening agent (H-1) | 0.17 |
| Fifteenth layer (back layer) | |
| Gelatin | 2.50 |
| Sixteenth layer (back protective layer) | |
| Mixture of polymethyl methacrylate particles (mean particle size 2.4 microns) and silicon oxide (mean particle size 5 microns) in equal amounts | 0.05 |
| Gelatin | 2.00 |
| Gelatin hardening agent (H-1) | 0.11 |

Preparation of Emulsion EMI

An aqueous solution of potassium bromide (8.5 weight % (1.5 mol)) and an aqueous solution of silver nitrate (8 weight % (1 mol)) were added simultaneously to an aqueous solution of gelatin, with vigorous stirring, at 75° C. over the course of 15 minutes to obtain an emulsion of octahedral silver bromide grains with a mean grain size of 0.40 micron. To the resulting emulsion were successively added 0.3 g of 3,4-dimethyl-1,3-thiazoline-2-thione, 6 mg of sodium thiosulfate, and 7 mg of chloroaurate (tetrahydrate), each amount per mol of silver, and the mixture was chemically sensitized by heating for 80 minutes at 75° C. The resulting grains as the cores were grown further under the same precipitation conditions as in the preceding step to obtain octahedral, monodisperse, core-shell silver bromide grains with a mean grain size of 0.7 micron. The coefficient of variation for the grain size was about 10%. To the thus-obtained emulsion were added 1.5 mg of sodium thiosulfate and 1.5 mg of chloroaurate (tetrahydrate), each amount per mol of silver, and chemical sensitization was performed by heating at 60° C. for 60 minutes, whereby an internal latent image type silver halide emulsion was obtained.

For each photosensitive layer ExZK-1 was added as a nucleating agent in an amount of $10^{-3}$ weight %, and Cpd-24 as a nucleation promotor in an amount of $10^{-2}$ weight %, each amount based on the amount of silver halide coated. Furthermore, Alkanol XC (Dupont) and sodium alkylbenzenesulfonate were used as emulsion dispersing aids, and succinic acid ester and Magefac F-120 (Dainippon Ink and Chemicals, Inc.) as coating aids, for each of the layers. Cpd-19, 20 and 21 were used as stabilizers for the layers containing silver halides and colloidal silver.

This sample was designated as Sample No. A3. The compounds used herein are described below.

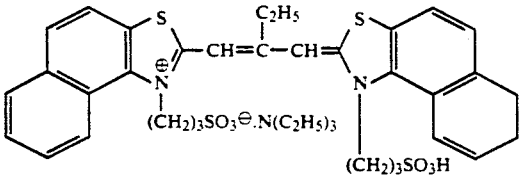
ExS-1
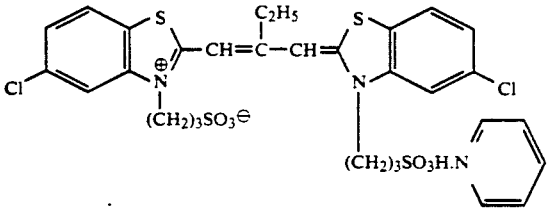
ExS-2
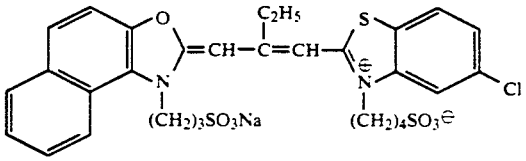
ExS-3
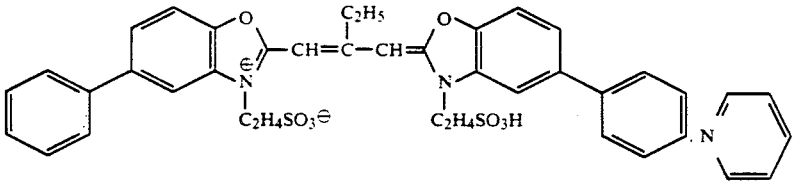
ExS-4
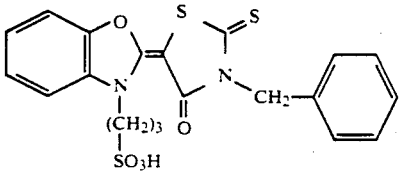
ExS-5
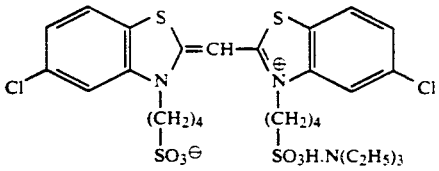
ExS-6
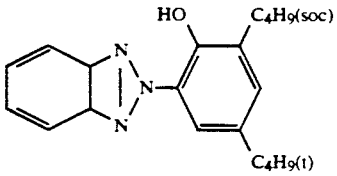
Cpd-1
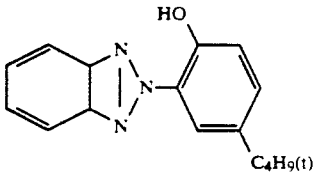
Cpd-2

-continued
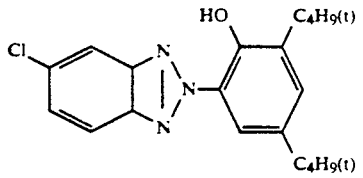
Cpd-3
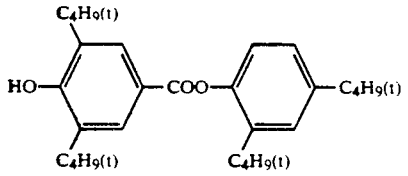
Cpd-4
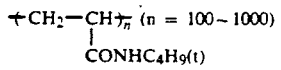
Cpd-5
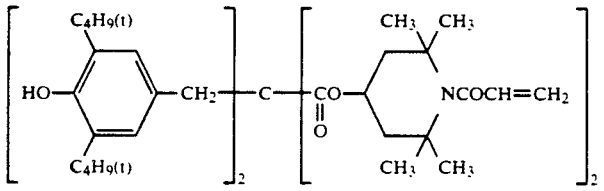
Cpd-6
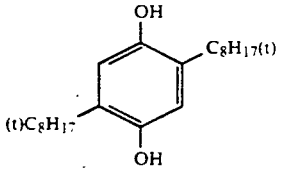
Cpd-7
Polyethyl acrylate (particle size: 0.01 micron)
Cpd-8
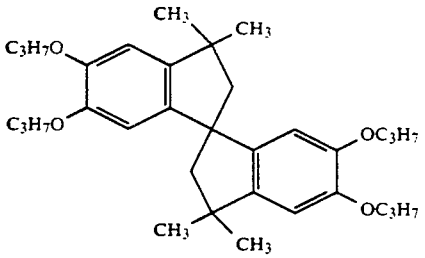
Cpd-9
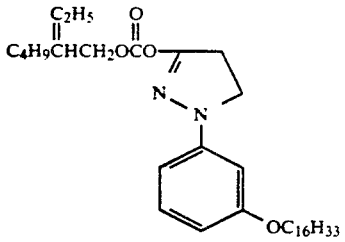
Cpd-10
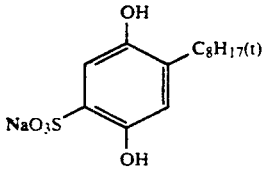
Cpd-11

-continued
Cpd-12
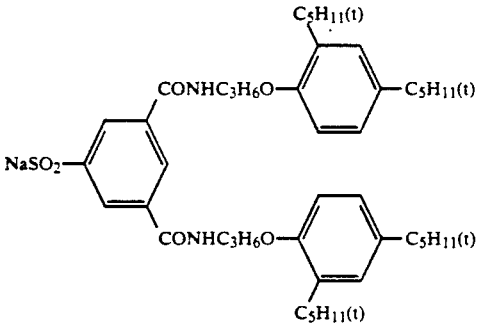
Cpd-13
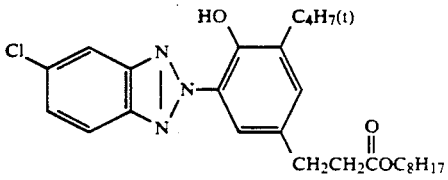
Cpd-14
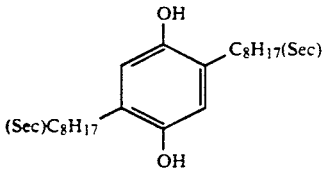
Cpd-15
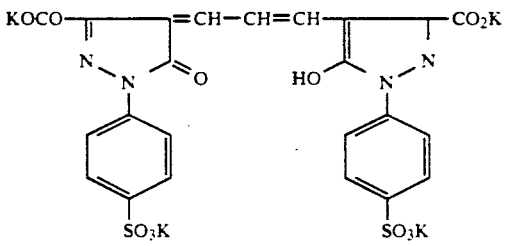
Cpd-16
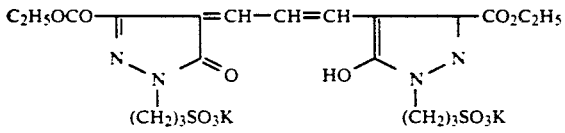
Cpd-17
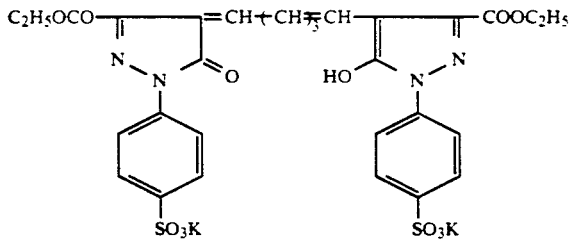
Cpd-18
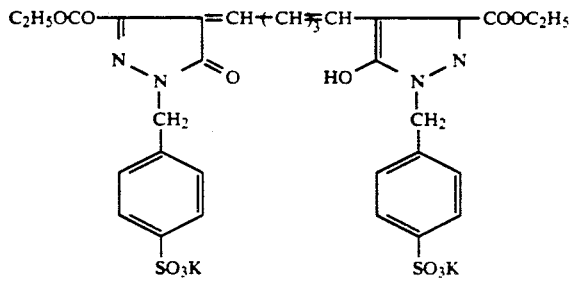

-continued
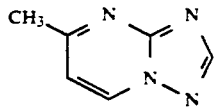
Cpd-19
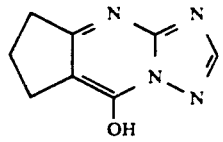
Cpd-20
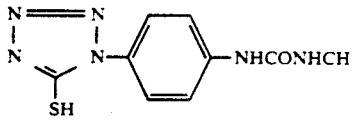
Cpd-21
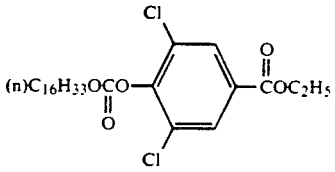
Cpd-22
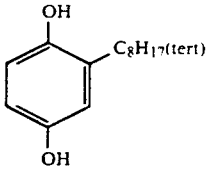
Cpd-23
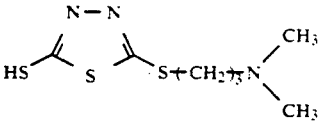
Cpd-24
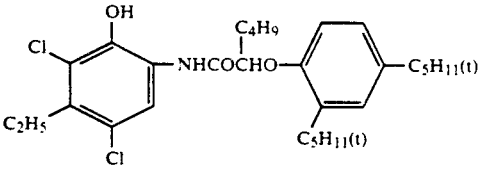
ExC-1
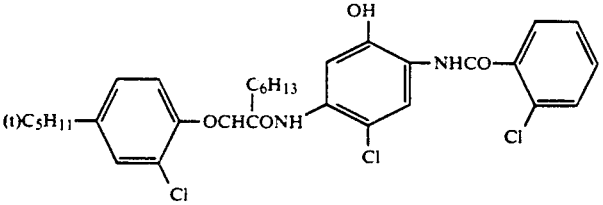
ExC-2
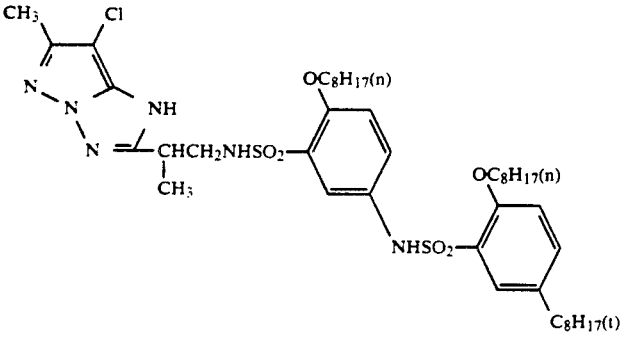
ExM-1

-continued

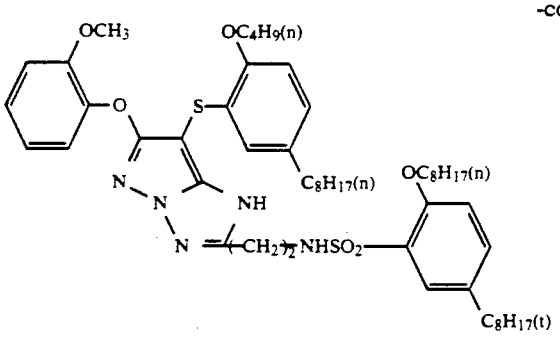

ExM-2

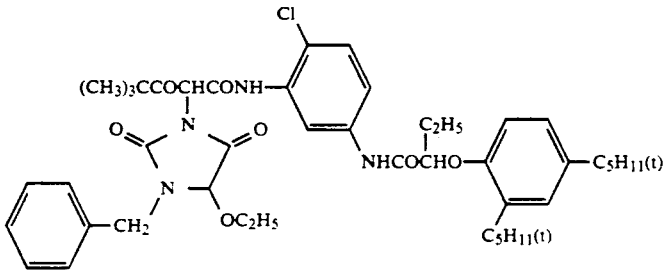

ExY-1

Figure 2:
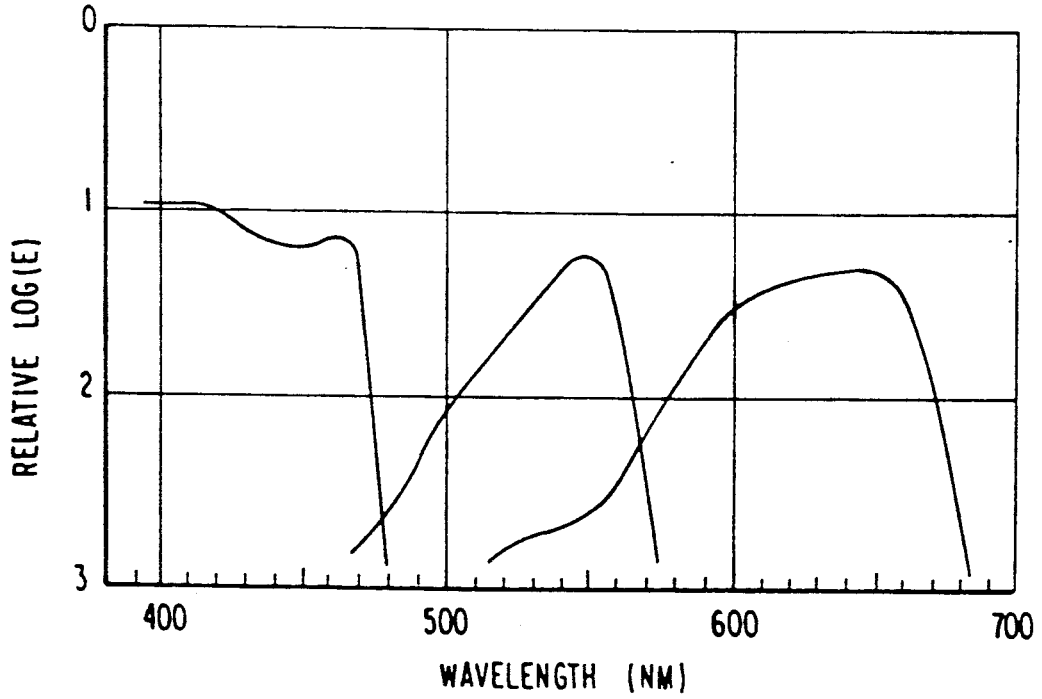
FIG. 2 shows the uniform energy spectral sensitivity distribution of Sample No. 300 of Example 2.

Solve-1: Di(2-ethylhexyl) phthlate
Solve-2: Trinonyl phosphate
Solve-3: Di(3-methylhexyl) phthalate
Solve-4: Tricresy phosphate
Solve-5: Dibutyl phthalate
Solve-6: Trioctyl phosphate
Solve-7: Di(2-ethylhexyl) sebacate
H-1: 1,2-Bis(vinylsulfonylacetamido)ethane
ExZK-1: 7-[3-(5-Mercaptotetrazol-1-yl)benzamido]-10-propargyl-1,2,3,4-tetrahydroacridinium perchlorate The results obtained by measuring the uniform energy spectral sensitivity spectrum are shown in FIG. 2. The peak wavelength of blue-sensitive layer, green-sensitive layer or red-sensitive layer was 465 nm, 545 nm or 645 nm, respectively. Further, the longest spectral sensitivity wavelength of blue-sensitive layer or green-sensitive layer was 480 nm or 573 nm, respectively.

A Macbeth color checker was photographed with a color negative film (SHR-100, a product of Fuji Photo Film Co., Ltd.), which was printed on a color paper (a product of Fuji Photo Film Co., Ltd.) to make an original. The same Macbeth color checker was photographed with a color reversal film (RFP, a product of Fuji Photo Film), and the photograph was subjected to color separation by means of a color scanner to make a printed matter. This way two types of reflection type originals were prepared. These originals were exposed and projected with an ordinary reflex printer onto the photosensitive material that had been obtained in the above-described manner. The photosensitive materials were developed by a processing step to be described below, whereby color prints were obtained. During printing, filter Nos. 111, 115, 121 119, 120 and 122 to 129 as used in Example 1 were disposed on the light source side of the printer as shown in Table 3, whereby prints were obtained in the same manner. The prints were adjusted for density and color such that the gray patch of Neutral 5 of the Macbeth color checker for the color paper as the original produced a gray with a density of 1.0. Exactly the same printing conditions were employed for the printed matter as the original.

Processing step

| | Time (sec.) | Temp (°C.) | Amount of Replenisher (ml/m$^2$) |
|---|---|---|---|
| Color development | 90 | 40 | 300 |
| Bleach-fix | 40 | 38 | 300 |
| Washing (1) | 30 | 38 | |
| Washing (2) | 30 | 38 | 300 |

For this step, the washing water was replenished in an amount of 8.6 times the amount of the original volume.

| Color developing solution | Solution | Replenisher |
|---|---|---|
| Ethylenediaminetetraacetic acid gdisodium salt dihydrate | 1.0 g | 1.0 |
| Sodium sulfite | 2.0 g | 2.5 g |
| Sodium bromide | 0.3 g | — |
| Hydroxylamine sulfate | 2.6 g | 3.3 g |
| Sodium chloride | 3.2 g | 1.5 g |
| 3-Methyl-4-amino-N-ethyl-N-hydroxyethylaniline | 7.0 g | 9.3 g |
| Potassium carbonate | 30.0 g | 30.0 g |
| Brightening agent (stilbene type) | 1.0 g | 1.3 g |
| Pure water to make | 1000 ml | 1000 ml |
| pH | 10.50 | 10.900 |

The pH was adjusted with potassium hydroxide or hydrochloric acid.

| Bleach-fix bath | (Solution was same Replenisher) |
|---|---|
| Ammonium thiosulfate | 100 g |
| Sodium hydrogen zincate | 21.0 g |
| Ammonium ethylenediaminetetraacetato ferrate (III) dihydrate | 50.0 g |
| Disodium ethylenediaminetetraacetate dihydrate | 5.0 g |
| Pure water to make | 1000 ml |
| pH | 6.5 |

The pH was adjusted with aqueous ammonia or hydrochloric acid.

Washing Water

Pure water was used (solution same as replenisher).

The pure water used herein was tap water from which all cations other than hydrogen ions and all anions other than hydroxide ions were removed to less than 1 ppm by ion exchange.

The results are shown in Table 3.

TABLE 3

| Sample No. | Filter | Remarks | Relative sensitivity B | G | R | Color reproduction (chroma; color paper) Red | Blue | Color difference from original color paper | printed matter |
|---|---|---|---|---|---|---|---|---|---|
| 300 | Crude glass | Comp. Ex. | 100 | 100 | 100 | 9.2 | 9.5 | 12.2 | 18.2 |
| 301 | 111 | Comp. Ex. | 93 | 32 | 40 | 9.8 | 9.5 | 13.3 | 20.5 |
| 302 | 115 | This invention | 94 | 88 | 89 | 11.8 | 9.6 | 10.8 | 12.4 |
| 303 | 121 | This invention | 81 | 45 | 53 | 11.5 | 11.9 | 10.4 | 10.6 |
| 304 | 119 | This invention | 94 | 84 | 86 | 12.0 | 9.6 | 9.3 | 9.5 |
| 305 | 120 | This invention | 93 | 82 | 84 | 12.3 | 9.6 | 9.3 | 9.4 |
| 306 | 122 | This invention | 95 | 84 | 97 | 11.5 | 12.3 | 9.8 | 10.0 |
| 307 | 123 | This invention | 95 | 81 | 97 | 11.5 | 12.4 | 9.8 | 9.9 |
| 308 | 124 | This invention | 96 | 90 | 90 | 12.4 | 9.8 | 9.3 | 9.2 |
| 309 | 125 | This invention | 96 | 95 | 84 | 12.6 | 9.8 | 9.2 | 9.8 |
| 310 | 126 | This invention | 96 | 95 | 70 | 12.6 | 9.7 | 9.8 | 10.5 |
| 311 | 127 | This invention | 96 | 95 | 87 | 12.7 | 9.8 | 9.3 | 9.3 |
| 312 | 128 | This invention | 96 | 95 | 88 | 13.0 | 9.9 | 8.9 | 9.2 |
| 313 | 129 | This invention | 96 | 95 | 86 | 13.0 | 9.9 | 8.9 | 9.2 |

In Table 3, relative sensitivity and color reproduction (chroma) have the same meaning as in Example 1, the color difference from the original is the mean of color differences according to CIE Lab color space for the 18 colors of the Macbeth color checker, as described in CIE (1976). The left column for this item gives the values for the color paper as the original, and the right column, for the printed matter. The table shows that when printing was performed with the use of the filter in accordance with this invention, the decline in sensitivity was minimal, color reproduction was improved, and color differences associated with differences in the type of the original (e.g. color paper vs. printed matter) was minimized.

Further, Table 3 shows that Sample Nos. 306 to 313 obtained by exposing photosensitive materials to light which was cut light in the longer wavelength side than that of the overlapped region of spectral sensitivity were particularly good.

As described above, this invention provides positive-positive color photographic images having excellent color reproduction even with the use of the subtractive process satisfactory in the productivity of printing work.

While the invention has been described in detail and with reference to specific embodiments thereof, it will be apparent to one skilled in the art that various changes and modifications can be made therein without departing from the spirit and scope thereof.

What is claimed is:

1. A method for forming a color positive image which comprises the steps of:

(a) exposing a color positive type silver halide material containing a support having thereon a blue-sensitive layer, a green-sensitive layer and a red-sensitive layer to light either transmitted or reflected from a color original and passed through a filter having at least one absorption band where light is absorbed in a sharp width; at least one absorption peak thereof being longer than the longest wavelength of the spectral sensitivity distribution of said blue sensitive layer and being shorter than an absorption peak wavelength of the spectral sensitivity distribution of said green-sensitive layer, or being longer than the longest wavelength of the spectral sensitivity distribution of said green-sensitive layer and being shorter than an absorption peak wavelength of the spectral sensitivity distribution of said red-sensitivite layer; the optical density of said absorption peak being at least 0.8; the $\frac{3}{4}$ value width of said absorption peak, designated as W $\frac{3}{4}$, being at least 5 nm and the $\frac{3}{4}$ value width of said absorption peak and the $\frac{1}{4}$ value width of said absorption peak, designated as W $\frac{1}{4}$, satisfying the following relation:

$$W\tfrac{3}{4} - W\tfrac{1}{4} \leqq 30 \text{ nm};$$

and (b) developing the exposed material.

2. The method as claimed in claim 1, wherein an optical density of absorption peak of said filter is at least 1.5.

3. The method as claimed in claim 1, wherein said filter has at least one absorption peak in a wavelength of from 580 to 620 nm.

4. The method as claimed in claim 1, wherein said filter has at least one absorption peak in a wavelength of from 480 to 520 nm.

5. The method as claimed in claim 1, wherein said filter has an absorption peak in a wavelength of from 480–520 nm and an absorption peak in a wavelength of from 580–620 nm.

6. The method as claimed in claim 1, wherein said $\frac{3}{4}$ value width of said absorption peak is from 5 nm to 35 nm.

7. The method as claimed in claim 1, wherein said $\frac{3}{4}$ value width of said absorption peak is from 10 nm to 25 nm.

8. The method as claimed in claim 1, wherein $W\frac{3}{4} - W\frac{1}{4} \leqq 20$ nm.

9. The method as claimed in claim 1, wherein $W\frac{3}{4} - W\frac{1}{4} \leqq 10$ nm.

10. The method as claimed in claim 1, wherein said filter has a transmittance of at least 80%.

11. The method as claimed in claim 1, wherein said filter absorbs ultraviolet light at a wavelength of at most 400 nm and infrared light at a wavelength of at least 700 nm.

12. The method as claimed in claim 1, wherein said filter is present between a light source means for providing said light and a reflecting original means for forming the image for exposing said color positive material.

13. The method as claimed in claim 1, wherein said color positive material is selected from a coupler-in-developer color reversal film; a coupler-in-emulsion color reversal paper; a coupler-in-emulsion color reversal film; a color paper capable of providing a positive image by a silver dye bleach process; an autopositive color film; an autopositive color paper; an instant photography film capable of forming a positive image by a diffusion transfer process; a heat developable color film capable of forming a positive image; and a heat developable color paper capable of forming a positive image.

14. The method as claimed in claim 1, further comprising fogging said exposed color positive material after said step of imagewise exposing said material and prior to or during said step of developing said material.

15. The method as claimed in claim 14, wherein said fogging comprises at least one of light fogging and developing said material in the presence of a nucleating agent.

* * * * *